US010077616B2

(12) United States Patent
Stachowiak, Jr.

(10) Patent No.: US 10,077,616 B2
(45) Date of Patent: Sep. 18, 2018

(54) WIPER AND SEAL ASSEMBLY FOR A PUMP

(71) Applicant: Weatherford/Lamb, Inc., Houston, TX (US)

(72) Inventor: John Edward Stachowiak, Jr., Houston, TX (US)

(73) Assignee: WEATHERFORD TECHNOLOGY HOLDINGS, LLC, Houston, TX (US)

( * ) Notice: Subject to any disclaimer, the term of this patent is extended or adjusted under 35 U.S.C. 154(b) by 829 days.

(21) Appl. No.: 14/530,461

(22) Filed: Oct. 31, 2014

(65) Prior Publication Data

US 2015/0136384 A1 May 21, 2015

Related U.S. Application Data

(60) Provisional application No. 61/898,733, filed on Nov. 1, 2013.

(51) Int. Cl.

| | |
|---|---|
| ***E21B 17/10*** | (2006.01) |
| ***E21B 43/12*** | (2006.01) |
| ***F04B 47/00*** | (2006.01) |
| ***E21B 33/08*** | (2006.01) |
| ***F04B 47/02*** | (2006.01) |
| ***E21B 33/10*** | (2006.01) |

(52) U.S. Cl.

CPC ..... *E21B 17/1071* (2013.01); *E21B 17/10* (2013.01); *E21B 17/1042* (2013.01); *E21B 33/08* (2013.01); *E21B 33/10* (2013.01); *E21B 43/126* (2013.01); *F04B 47/00* (2013.01); *F04B 47/02* (2013.01); *Y10T 137/794* (2015.04)

(58) Field of Classification Search

CPC .. E21B 14/10; E21B 14/1042; E21B 14/1071; E21B 43/126; F16C 33/74; F16C 33/741

USPC ..... 277/328, 337, 338

See application file for complete search history.

(56) References Cited

U.S. PATENT DOCUMENTS

| | | | | |
|---|---|---|---|---|
| 5,343,944 A * | 9/1994 | Bassinger | ..... | E21B 33/08 166/84.4 |
| 5,628,516 A * | 5/1997 | Grenke | ..... | E21B 33/085 277/300 |
| 8,870,187 B2 * | 10/2014 | Murray | ..... | E21B 4/003 166/179 |
| 2015/0240586 A1 * | 8/2015 | Sherrill | ..... | E21B 33/12 166/387 |

* cited by examiner

*Primary Examiner* — David J Bagnell
*Assistant Examiner* — Tara E Schimpf
(74) *Attorney, Agent, or Firm* — Patterson + Sheridan, LLP

(57) ABSTRACT

A tubing pump includes a seal housing insertable into a production string of tubing with a seal assembly mounted in an interior of the seal housing. The assembly includes at least an upper seal and seal holder and a lower seal and seal holder, each seal energizable by fluid to provide a fluid-tight seal around a reciprocating tubular member. The seals and holders are isolated from each other in a manner whereby the lower seal remains un-energized until the seal above it fails.

4 Claims, 4 Drawing Sheets

WIPER AND SEAL ASSEMBLY FOR A PUMP

BACKGROUND OF THE INVENTION

Field of the Invention

Embodiments of the invention relate to a wiper and seal assembly that prevents debris, such as sand particles, from entering an operating region of a pump.

Description of the Related Art

To obtain fluids from an earth formation, a wellbore is drilled into the earth to intersect an area of interest within the formation. Upon reaching the area of interest, artificial lift means is often necessary to carry production fluid (e.g. hydrocarbon fluid) from the area of interest within the wellbore to the surface. Some artificially lifted wells are equipped with sucker rod lifting systems.

Sucker rod lifting systems generally include a surface drive unit, a sucker rod string, and a downhole pump. The pump generally includes an outer barrel and an operating member, such as a plunger, axially movable within the barrel to lift fluid to the surface. The sucker rod string generally comprises several rods connected together but may be one continuous rod, and is the primary link between the drive unit at the surface and the pump plunger. In one instance, reciprocating pumping action moves a traveling valve on the pump plunger, collecting fluid on the down-stroke and lifting the fluid to the surface on the up-stroke.

Sucker rod-type lifting systems include insert pumps, where the entire assembly is run into the well with its own string of tubulars attached to the sucker rod string. These pumps are easy to get in and out of the well, but result in a smaller diameter and fluid path for the collection of hydrocarbons. Tubing pumps, on the other hand, have barrels that are actually screwed into and become part of the production string. The result is a greater capacity but difficulty in removing and repairing the barrel due to its location in the production string.

One problem associated with sucker rod lifting systems is wear within the annular region between the plunger and the barrel due to wellbore debris, such as sand. Since the annular region is typically about 0.002 inches to about 0.005 inches (per side), sand particles of various size enter the region and act as an abrasive, which quickly forms "grooves" in both the barrel and the plunger sliding surfaces. Such wear significantly diminishes the life of the barrel and the plunger, and can lead to costly repair and frequent maintenance. With tubing pumps, wear is a particular problem due to the difficulty of recovering and replacing the barrel portion of the pump.

Therefore, there is a need for an improved assembly to prevent debris from entering an operating region of a pump.

SUMMARY OF THE INVENTION

The present invention generally relates to downhole pumps. In one embodiment, a tubing pump includes a seal housing insertable into a production string of tubing with a seal assembly mounted in an interior of the seal housing. The assembly includes at least an upper seal and seal holder and a lower seal and seal holder, each seal energizable by fluid to provide a fluid-tight seal around a reciprocating tubular member. The seals and holders are isolated from each other in a manner whereby the lower seal remains un-energized until the seal above it fails.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

Figure 1:
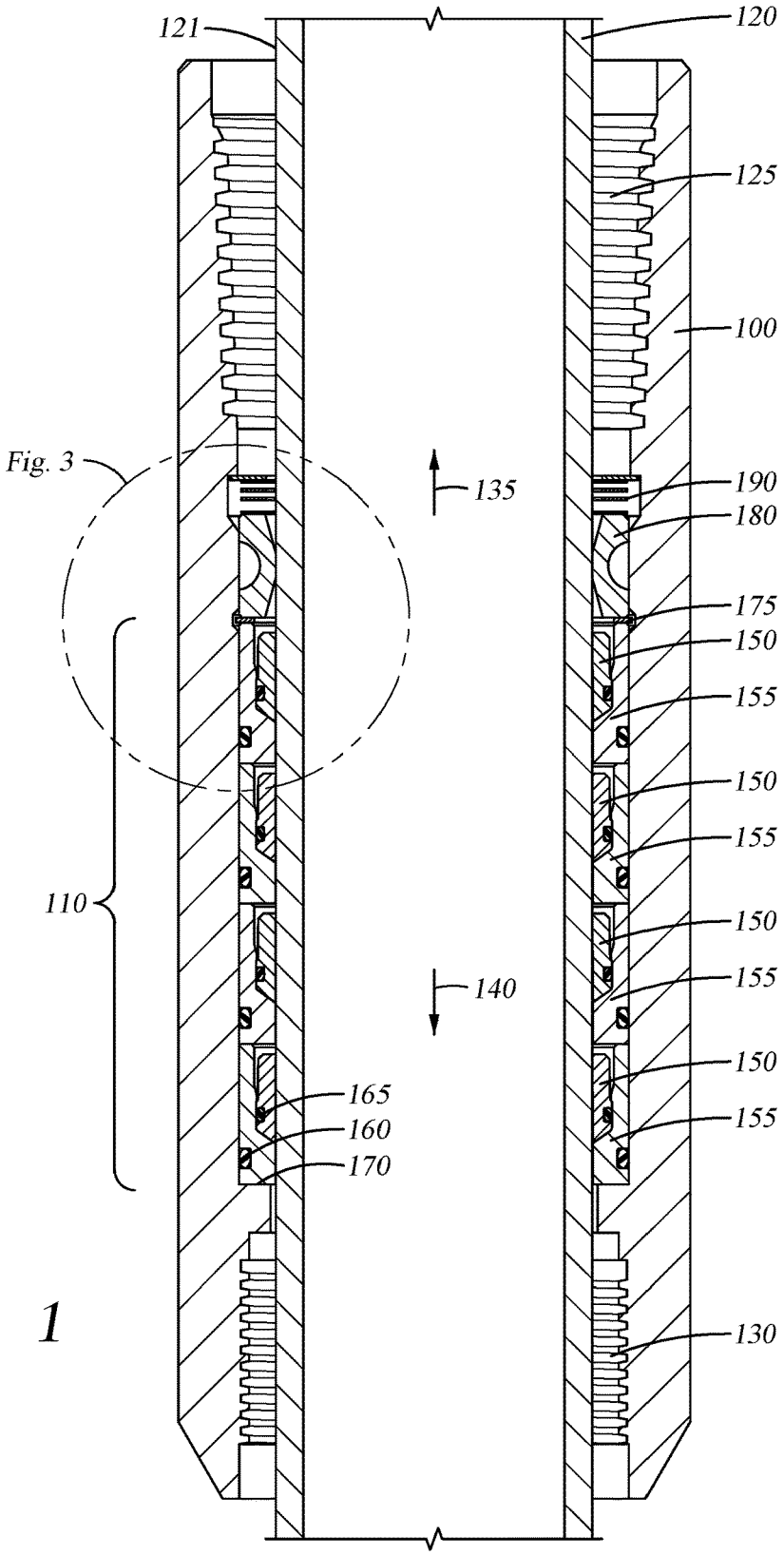
FIG. 1 is a section view of a seal housing, a seal assembly and a centralizer within the seal housing and a plunger inside the seal assembly.

FIG. 1 is a section view of certain parts of a tubing pump. Parts shown include a seal housing 100, a seal assembly 110 within the housing and a plunger 120 inside the seal assembly. Typically, the seal housing is installed as a "sub" in a tubing string 101 at a location above a barrel 121. Threads at an upper 125 and lower 130 end of the seal housing permit its installation in the string. Tubing pumps are well known in the art and their operation is disclosed in U.S. Pat. No. 5,765,639 which is incorporated by reference herein in its entirety. In operation, the plunger 120 is connected at an upper end to a rod string and is reciprocated as shown by directional arrows 135, 140 while the other parts of the pump, including the barrel and seal assembly, remain stationary.

Figure 3:
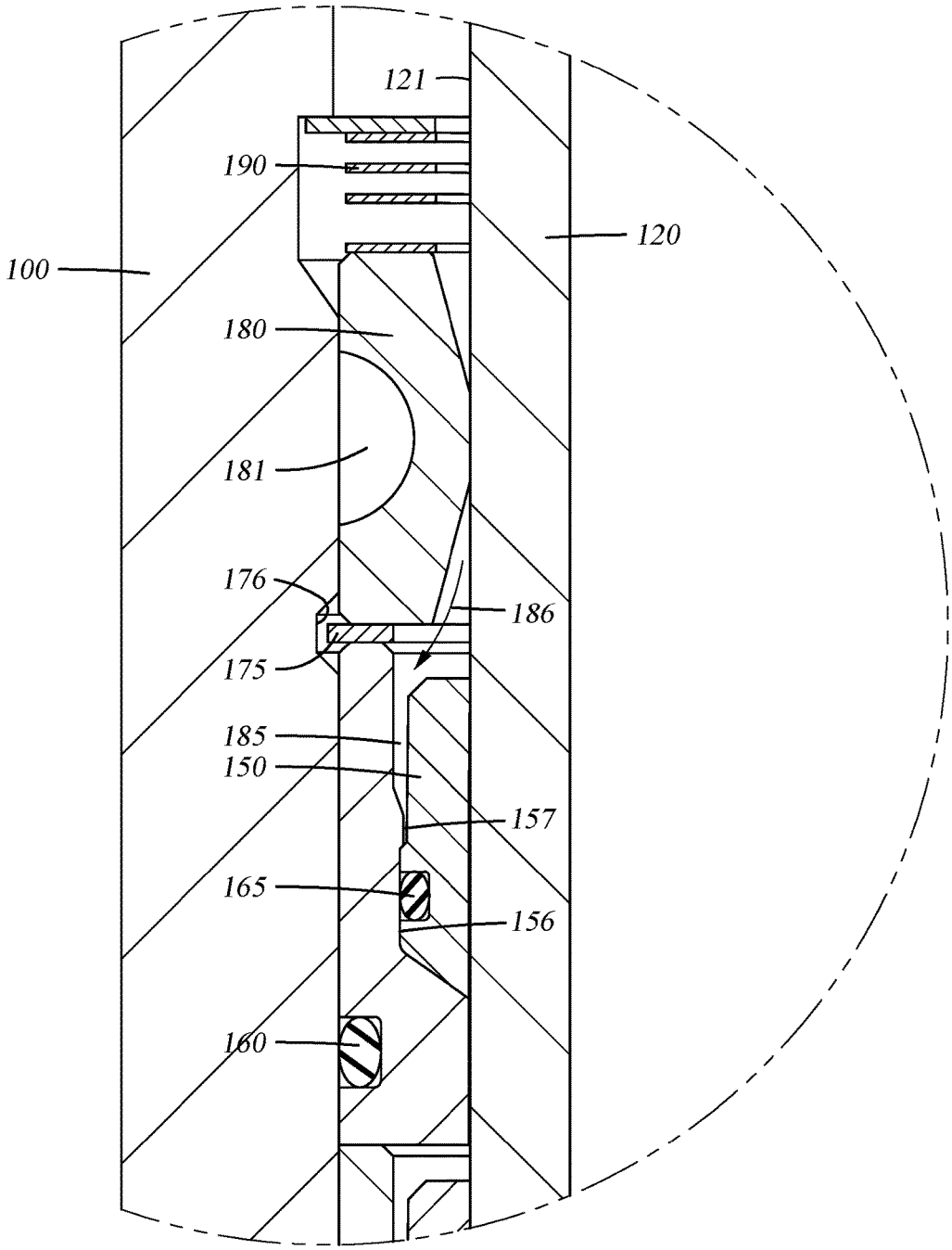
FIG. 3 is an enlarged section view showing a section of the seal assembly and the centralizer of FIG. 1.

The seal assembly described herein is primarily intended for use in a tubing pump having a plunger that is relatively long and a barrel that is relatively short. For example, in the preferred embodiment, a seal housing is installed above the barrel and the plunger is of a sufficient length to reciprocate without exiting the barrel or the seal housing as it moves between its upper and lower strokes. As shown in FIG. 1, the seal assembly in one embodiment includes four separate seals 150 that are stacked in an inner wall of the seal housing 100 in a manner whereby the seals seal an annular area created between themselves and the plunger 120. Each seal includes a seal holder 155. O-rings 160 seal an area between the seal holder, and seal holder wall and O-rings 165 seal an area between the seal holder and the seal. In the embodiment shown, the seal assembly is held at a lower end by a shoulder 170 formed in the inside wall of the seal housing 100 and at an upper end by a snap ring 175 that seats in a groove 176 (FIG. 3). The seals 150 are intended to be redundant with only the uppermost seal being energized at any one time. Each lower seal becomes energized and operates only as the seal above it fails. However, the seals all operate together with each providing a wiping function as the plunger moves past them. The embodiment shown uses four seals 150, but it will be understood that the invention can be practiced with as many or as few redundant seals as is desired, limited only by space and expected wear on the seals. By stacking seals in a manner that permits them to act in series, the sealing function lasts longer, and expensive and time-consuming removal of the tubing string due to failed seals or damaged pump components is delayed or avoided.

Figure 2:
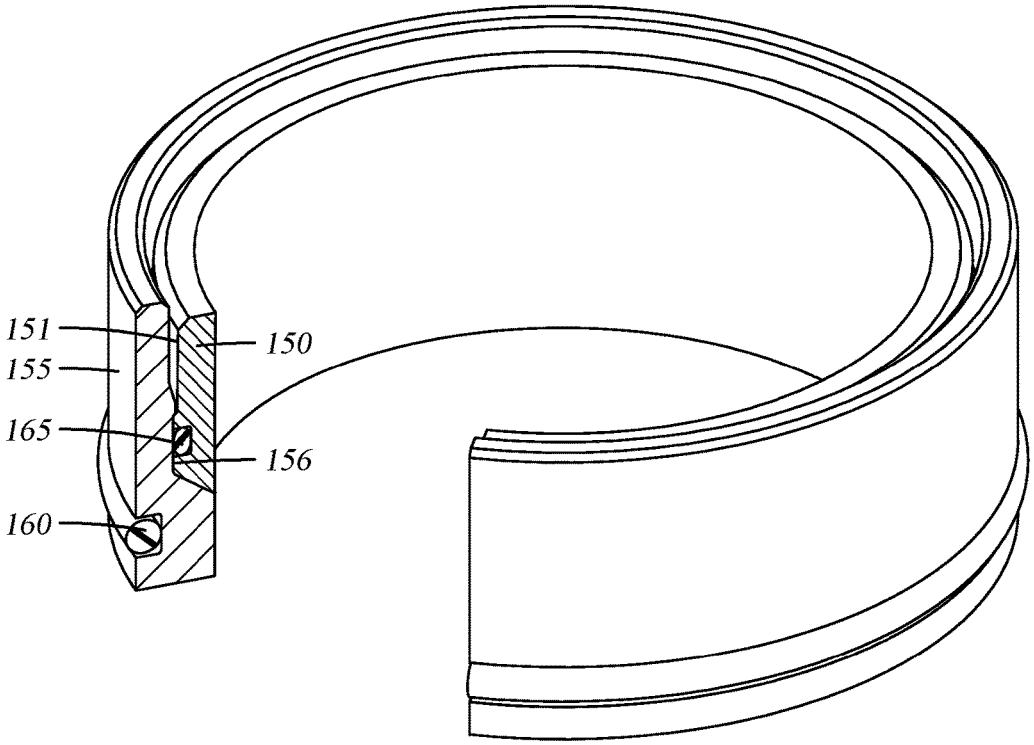
FIG. 2 is an isometric view showing a seal holder and seal.

FIG. 2 is an isometric view of a seal holder 155 and seal 150, and FIG. 3 is an enlarged view of the seal/seal holder and a centralizer 180. Considering both figures, the seal holder 155 includes an inner surface 156 which mates to an outer surface 151 of the seal 150. When assembled, the cylindrical seal 150 is lowered into the cylindrical seal holder 155 until interference between the surfaces 156, 151 causes it to "snap" into place and be retained by a formation 157 formed on surface 156. A gap 185 remains between an upper part of the seal 150 and the holder 155 to receive pressurized fluid (primarily when the plunger 120 moves upwards 135 in the housing 100) and help energize the seal. In one embodiment, the seal 150 is constructed of a robust Teflon-like material. In another embodiment the seal is constructed of a more pliable material whereby the seal is deformable due to the mating 45 degree angles between the seal and the lower surface of the seal holder 155 (FIG. 3). By providing an assembly in which each seal 150 has its own holder 155, the seal elements 150 are isolated from each other and the energizing and operation of each is separate from the others. In this way the seals do not seal in unison but rather, each remains essentially unused until the one above it fails.

Each seal 150 is installed in its seal holder 155 in a manner that permits fluid (arrow 186) to enter gap 185 and act on the rear surface 151 of the seal 150, thereby "energizing" the seal in the direction of the reciprocating plunger 120. In this manner, a fluid column above the seal 150 acts to assure its sealing action against the surface of the plunger 120. As the uppermost seal becomes worn and/or damaged, its integrity fails and the fluid is permitted to contact the seal therebelow, energizing it against the plunger. In this manner, multiple redundant seals are available to be used in series to avoid having to pull the tubing string (and with it the seal housing 100 and seal assembly 110) from the well. In every case, the reciprocating plunger is wiped by each seal, even those that are not operating to seal the plunger.

Also shown in FIG. 3 is the centralizer 180 which is mounted above the seal assembly 110. In the embodiment shown, the centralizer's role is to ensure that the plunger 120 is centered relative to the seals 150 as it is initially inserted into the seal housing 100. The centralizer 180 has a slightly smaller inside diameter than the outside diameter of the plunger 120. In this manner, the inside diameter of the centralizer deforms slightly as the plunger initially passes through, ensuring an entry in the center of the housing 100 and also wiping an outer surface of the plunger 120 as it reciprocates during use. A "cutout" 181 allows the centralizer to act like a hinge, thus reducing the amount of force required for the plunger to pass through. The centralizer 180 is retained in the housing by the snap ring 175 at a lower end and by a retaining member 190 at an upper end. The retaining member may be a spring that acts to keep the centralizer biased towards the plunger 120.

In one example of operation, the seal assembly described herein is assembled by stacking a predetermined number of seal holders 155 with upper and lower diameters and seals 150 with upper and lower diameters on the seal housing 100. As disclosed, each seal and seal holder mates together, in the housing and the assembly is held in place at an upper and lower end. A centralizer 180 is installed and in turn held in place by the retaining member 190 at an upper end thereof.

Thereafter, the seal assembly 110 within the seal housing 100 is installed as a sub in a production tubing string above a barrel of a tubing pump, ensuring that as the pump operates, its plunger will reciprocate across the surface of the seals 150. As the pump components are inserted into the well at the lower end of a sucker rod string, the plunger 120 encounters an upper end of the seal housing 100 where the centralizer 180 encounters a lower end of the plunger and guides it into the center of the seal housing, thereby avoiding damage to the seal assembly 110.

Once the pump is operating and the plunger 120 is reciprocating in the seal assembly 110, fluid enters a gap 185 between the uppermost seal 150 and its seal holder 155. The pressurized fluid acts on an O-ring 165 between the holder and seal element, especially during an upstroke of the plunger 120 when a column of production fluid is being raised toward the surface of the well. If and when the first seal becomes inoperable due to wear or damage, the process will be repeated utilizing the second seal and its holder. In this manner, four seals can operate, fail and all can act as wipers before the barrel and seal portion of the pump require removal.

Figure 4:
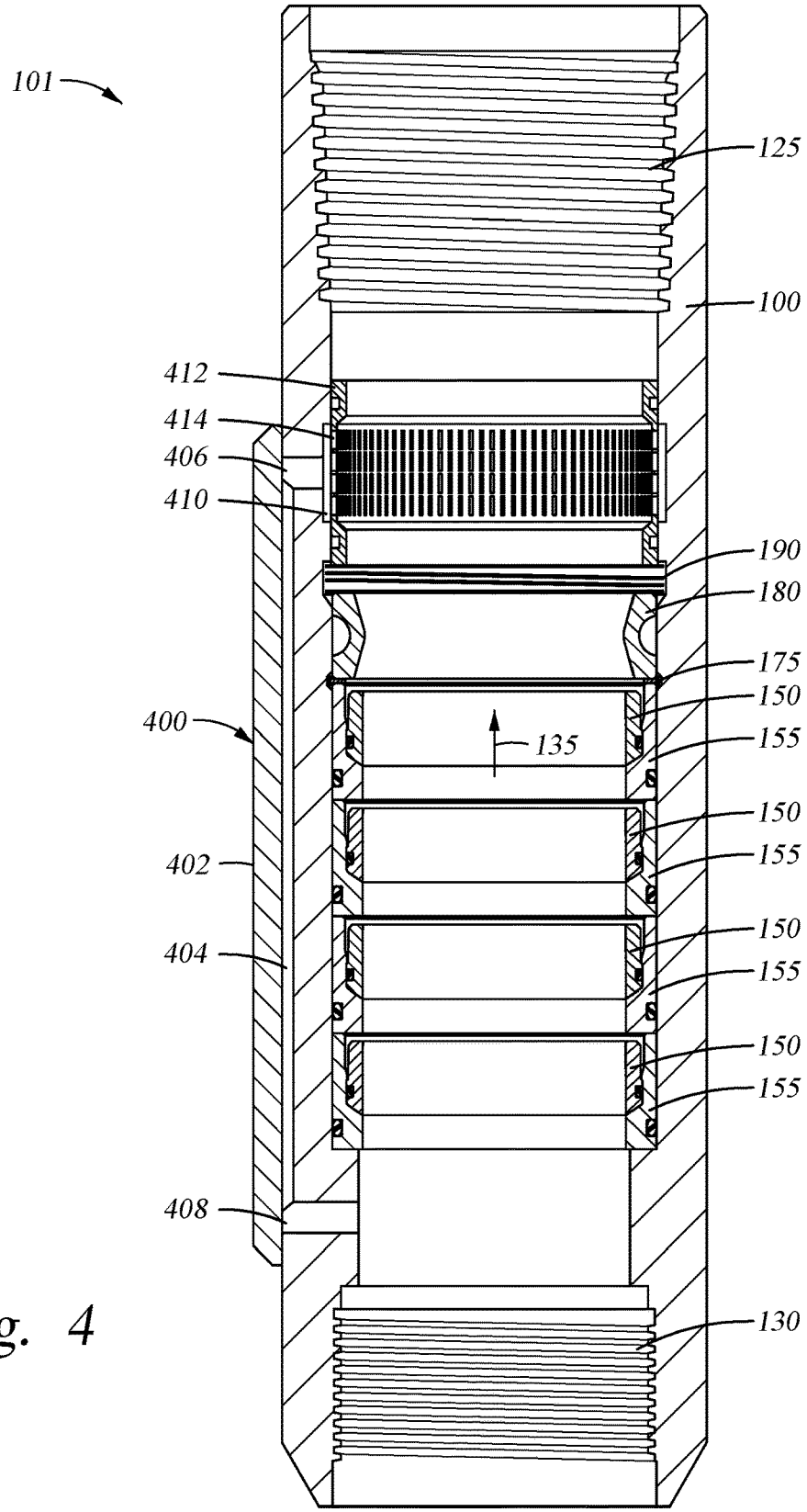
FIG. 4 is a section view showing an embodiment of the invention that includes a bypass.

FIG. 4 is a section view showing an embodiment of the invention that includes a bypass 400. As shown the bypass permits fluid to avoid the seal assembly as the pump operates. In one embodiment, the bypass is provided to ensure fluid "slippage" and increase the amount of fluid that passes from an upper to a lower end of the pump. The bypass consists of a housing 402 that houses a fluid path 404 of the bypass. The fluid path travels the length of the seal assembly from an upper port 406 to a lower port 408 where it is re-introduced into the pump. As illustrated by directional arrow 135, the bypass is designed to operate on the upstroke of the plunger 120. In the embodiment shown, a filter or screen 414 is installed at an upper end of the seal assembly to ensure that fluid bypassing the seals (with their wiping action) is filtered prior to contacting the pump components it will contact. A circumferential recess 410 is provided for fluid communication around the filter 414 and the filter is retained and sealed in the housing with a mounting plate 412. It is notable that even when the bypass is provided, the seals 150 act to wipe the surface of the plunger 120 as it moves past them.

While the foregoing is directed to embodiments of the present invention, other and further embodiments of the invention may be devised without departing from the basic scope thereof, and the scope thereof is determined by the claims that follow. For example, while the invention has been described with the seals on a stationary member, the invention can be used with the seals on the reciprocating member. Additionally, while the invention has been described for use in a tubing pump, it could also be used with other downhole pumps, like insert pumps.

The invention claimed is:

1. A seal for use in a downhole pump for sealing an annular area around a reciprocating plunger, the seal comprising:

an annular sealing element, the sealing element having an inner surface for contacting and sealing against an object and an outer surface having an upper smaller outer diameter portion and a lower, greater outer diameter;

a seal holder for housing the seal, the holder having an inner surface with a larger diameter portion and a smaller diameter portion therebelow, whereby, when the seal is inserted into the seal holder an annular space is formed between the upper smaller diameter portion of the seal and the larger diameter portion of the seal holder.

2. The seal of claim 1, wherein the annular space is constructed and arranged to be filled with pressurized fluid in a manner that urges the seal away from the inner surface of the seal holder and into sealing contact with the object.

3. The seal of claim 2, further including an inwardly extending formation on the inner surface of the seal holder separating the larger uppermost diameter and the remaining smaller diameter portions thereof, the inwardly extending formation constructed and arranged to provide an interference fit between the seal and seal holder thereby retaining the seal in the holder.

4. The seal of claim 3, wherein a plurality of seals are stackable in a manner whereby the seal holders contact each other while the seals remain isolated from each other.

* * * * *